United States Patent [19]

Olson

[11] 3,944,228

[45] Mar. 16, 1976

[54] CURLING STONE WASHER AND HANDLE ASSEMBLY

[75] Inventor: Herbert O. Olson, Edmonton, Canada

[73] Assignee: 2001 Plastics, Ltd., Edmonton, Canada

[22] Filed: Aug. 20, 1974

[21] Appl. No.: 499,021

[52] U.S. Cl. ..... 273/128 CS; 10/73; 85/50 R

[51] Int. Cl.[2] ..... A63B 71/00

[58] Field of Search.... 273/128 GS, DIG. 1, DIG. 7; 85/50; 151/3, 7; 10/72, 73

[56] References Cited

UNITED STATES PATENTS

| | | | |
|---|---|---|---|
| 506,923 | 10/1893 | Miles | 10/73 X |
| 3,166,316 | 1/1965 | O'Leary | 273/26 E |
| 3,212,387 | 10/1965 | Madansky | 85/50 R X |
| 3,507,498 | 4/1970 | Spencer | 273/128 CS |
| 3,547,445 | 12/1970 | Hardesty | 273/DIG. 7 |

FOREIGN PATENTS OR APPLICATIONS

| | | | |
|---|---|---|---|
| 696,933 | 11/1964 | Canada | 273/128 CS |
| 688,636 | 6/1964 | Canada | 273/128 CS |
| 729,051 | 3/1966 | Canada | 273/128 CS |
| 15,383 | 11/1887 | United Kingdom | 273/128 CS |

*Primary Examiner*—Richard C. Pinkham
*Assistant Examiner*—T. Brown
*Attorney, Agent, or Firm*—Clarence A. O'Brien & Harvey B. Jacobson

[57] ABSTRACT

A curling stone handle of one piece construction contoured to conform with the contour of the face of existing curling stones combined with a ribbed washer of plastic oriented interiorly of the cupped area only in the curling stone and a bolt extending through the curling stone and securing the handle and washer in place with the bolt including a head that will fit any curling stone recess and provided with a polygonal depression for receiving a wrench to facilitate assembly and disassembly of the handle, washer and bolt with respect to the curling stone. The washer is formed having a central bore and a plurality of radially extending ribs extending from the bore to the periphery of the washer. The ribs are provided with a flat side surface and a convex opposite curved surface, both surfaces extending substantially perpendicular from one flat side of the washer. The washer is placed between the curling stone and handle and having the ribs facing downward in contact with the curling stone. When the bolt is tightened to secure the handle to the curling stone the ribs will fold and be compressed to prevent relative movement between the handle and curling stone.

5 Claims, 5 Drawing Figures

CURLING STONE WASHER AND HANDLE ASSEMBLY

BACKGROUND OF THE INVENTION

1. Field of the Invention

The present invention relates to curling stone handles and more particularly to a one piece handle having a plate-like structure conforming with the contour of the curling stone, a ribbed plastic washer oriented only in the cup-shaped recess in the curling stone and a fastening bolt having a polygonal structure for receiving a wrench to enable assembly and disassembly of the handle and curling stone.

2. Description of the Prior Art

Curling stones have been in existence for many years and one of the problems encountered has been the provision of a handle on the curling stone for enabling it to be securely locked to the stone but yet easily assembled and disassembled. Most, if not all curling stones are quarried and finished in Britain and are of a particular type of granite and weigh approximately 40 pounds. Each stone is generally circular, from 5 to 5½ inches high and of a diameter of 10½ to 11 inches and includes a shallow cup or recess of approximately 5 inches in diameter on the top and bottom so that the stone may be turned over without regrinding the surface contact area. When the stone is turned over so that both surfaces may be used as the ice contact area before regrinding, the handle must be reversed in relation to the stone. Conventionally, curling stone handles have had a relatively small diameter metal plate to which a horizontal handle is rigidly affixed. An anchor bolt extends through a central hole in the curling stone and a leather washer is positioned between the plate and upper surface of the stone. The anchor bolt is provided with a pyramidal lower end which engages a recess in the stone around the central through hole to prevent the bolt from turning thereby enabling the handle to be tightened onto the stone by rotation of the handle. Due to the normal forces encountered, handles frequently become loosened and in order to tighten the conventional gooseneck handle, a rubber mallet is sometimes used to strike the handle or in other instances a slotted wood member is used to fit over the handle for rotation of the same.

U.S. Pat. No. 3,507,498, issued Apr. 21, 1970 discloses a plastic handle attached to a curling stone by a through bolt provided with a conical lower end and the base plate of the handle is provided with a depending peripheral flange resiliently engageable with the upper surface of the curling stone with the depending flange defining a plenum between the underside of the plate and the upper surface of the stone. In use, this plenum has been found to produce an echo sound when the stones contact each other and in the event the stone has a shallow cup, the central depression will engage the shallow cup prior to the flange frictionally engaging the top surface of the stone. The handle disclosed in this patent has not solved the problem of securely fastening a curling stone handle to the curling stone in a manner which enables the handle to be quickly and easily disassembled and reassembled in relation to the stone. Keeping this handle tight is very difficult as it depends entirely on the peripheral plastic flange frictionally engaging polished granite, which it does poorly. Excessive force used in tightening leads to plastic fracture.

SUMMARY OF THE INVENTION

An object of the present invention is to provide a curling stone handle incorporating three components, namely, a plate contoured to closely fit the upper surface of the curling stone and a gooseneck handle of unitary construction, a ribbed washer interposed between the plate and the cup depression in the upper surface of the stone and a retaining bolt extending through a central hole in the stone with the retaining bolt having a conical head on the lower end thereof with the conical head including a polygonal depression in its face to receive a wrench to facilitate threading of the screw bolt into a depending ferrule on the center of the contoured plate so that the plate, in effect, becomes intimately engaged with a substantial portion of the upper surface for not only securely locking the handle in place but also eliminating hollow air spaces which could produce echoes or other objectionable sounds.

A further object of the invention is to provide a curling stone handle in accordance with the preceding objects in which the handle is assembled by rotating the bolt rather than rotating the handle with the bolt being held stationary by its pyramidal head. This not only reduces the time required for disassembly and assembly of the handle but also enables the base plate of the handle and ribbed washer to be securely clamped without relative rotation between these components and the curling stone.

A further object of the invention is to provide a curling stone handle in accordance with the preceding objects in which the handle base plate is self-centering due to its contour which conforms with the contour of the stone.

Still another object of the invention is to provide a curling stone handle in which the plastic washer is provided with radiating ribs located primarily in the central portion of the washer with the ribs on the washer being only on the surface of the washer which engages the stone with the flat upper surface of the washer contacting the undersurface of the handle. The ribs are curved on one surface and flat on the other and are adapted to be compressed and fill any dead space in the cup area with the ribs, when compressed, folding over to provide an anti-rotation effect thus more securely locking the handle to prevent loosening thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
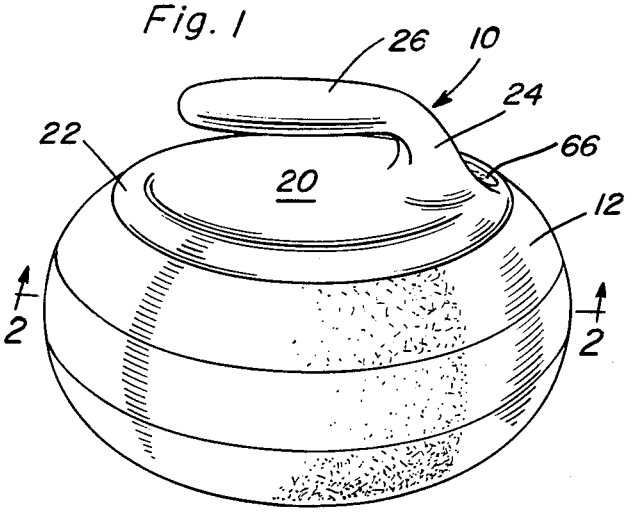
FIG. 1 is a perspective view of a curling stone and handle.
Figure 4:
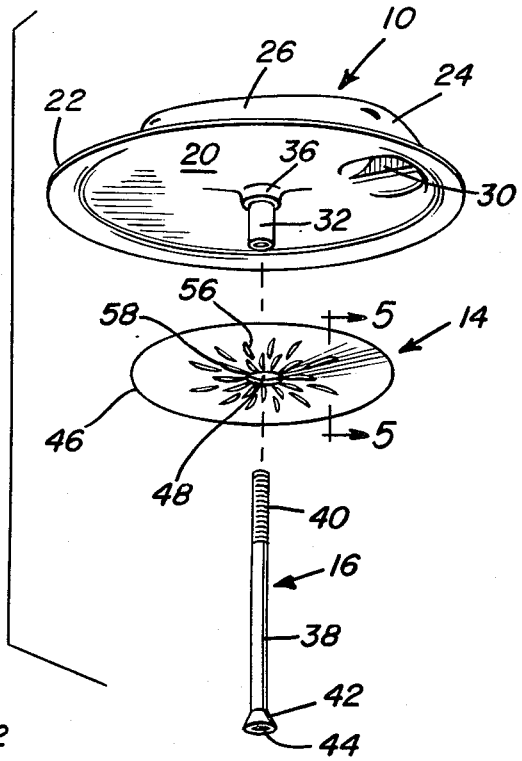
FIG. 4 is an exploded group perspective view illustrating the three components of the curling stone handle of the present invention.
Figure 3:
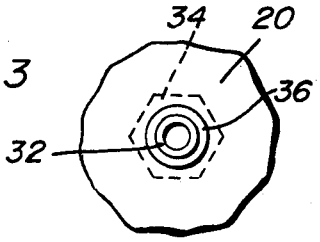
FIG. 3 is a fragmental view of the embedded ferrule in the base of the handle.

The curling stone handle is generally designated by reference numeral 10 and is illustrated in association with a conventional curling stone 12 and is secured thereto by a novel and unique washer generally designated by the numeral 14 and a novel and unique center bolt generally designated by the numeral 16. The curling stone or rock 12 is of conventional construction and conforms with conventional size and weight limitations with the usually provided cup-shaped recess or depression 13 in both the top and bottom surface. A through hole 15 is disposed centrally of the curling stone 12 with both ends of the through hole 15 being slightly flared outwardly as at 18. The curling stone 12 is completely conventional in construction and may be a newly manufactured stone of any suitable granite or it may be an old stone inasmuch as the handle 10, washer 14 and bolt 16 may be installed on conventional existing curling stones or newly manufactured curling stones with equal facility.

Figure 2:
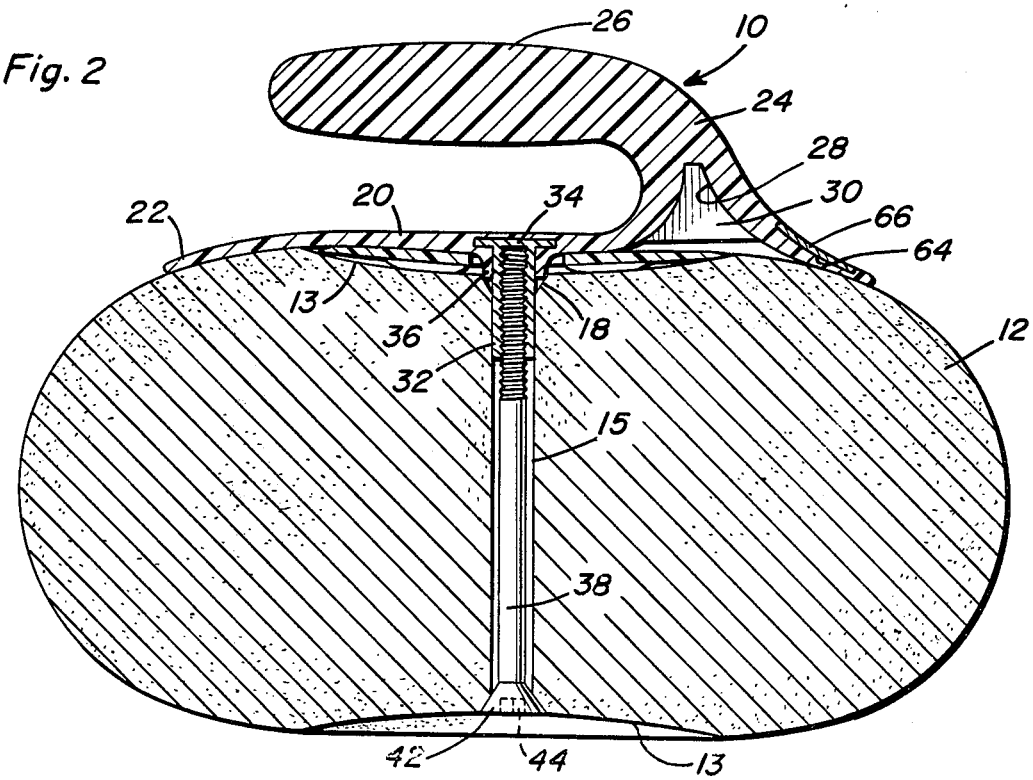
FIG. 2 is a vertical, sectional view taken substantially upon a plane passing along section line 2—2 of FIG. 1.

The handle 10 includes a circular plate 20 having a peripheral edge portion 22 which curves downwardly and conforms closely to the corresponding curved surface area of the curling stone 12 as illustrated in FIG. 2. At one side of the plate 20, an upstanding gooseneck handle 24 is provided which extends into and is of unitary construction with a generally horizontal handle 26 which overlies the plate 20 in spaced relation and substantially parallel relation thereto with the length of the handle 26 being less than the plate 20 so that the curling stone will be properly balanced when the horizontal handle is used to use the stone in a conventional manner. The hollow interior 28 of the gooseneck handle 24 is provided with a vertical reinforcing rib 30 to rigidify the horizontal handle in relation to the plate 20. The plate 20, its peripheral portion 22, the gooseneck handle 24 and the horizontal handle 26 are all constructed of one piece plastic. Plastic, such as "Lexan 500" or other polycarbonate glass-filled resins have sufficient strength and are not affected by severe heat or cold or instant change in temperature thus eliminating possible damage due to temperature changes and it has been found that this material will not fracture even when unusual forces are encountered.

Centrally of the plate 20 and in alignment with the through hole 15, the handle 10 includes an inserted ferrule 32 of internally threaded cylindrical construction. The ferrule 32 includes a hexagonal head 34 in the form of a plate which is embedded in the plate 20 of the handle 10. Where the ferrule 32 and the head 34 are received in the plate, the plate 20 includes a depending cylindrical flange 36 which surrounds a portion of the upper end portion of the ferrule 32 as illustrated in FIG. 2 thus rigidly affixing the ferrule 32 to the plate 20 so that an integral construction is formed.

The through bolt 16 includes an elongated shank 38 having a threaded end portion 40 and a conical head 42. The flat outer surface of the conical head 42 is provided with a hexagonal recess or depression 44 for telescopically receiving the end of an Allen wrench so that the bolt 16 may be rotated for threading the threaded end 40 thereof into the internally threaded ferrule 32 with the conical head 42 of the bolt 16 engaging the recess 18 for centering the bolt 16 and pulling the plate 20 downwardly into engagement with the stone 12 without the necessity of rotating the handle 10. As illustrated in FIG. 2, the external diameter of the ferrule 32 is such that it is closely received in the through hole 15 thus further serving to center the handle 10 in relation to the curling stone 12.

Figure 5:
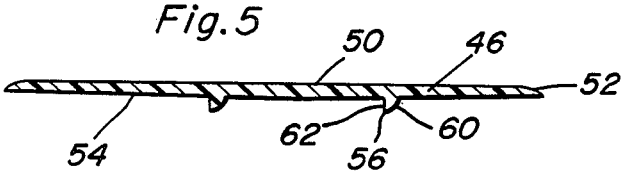
FIG. 5 is a detailed sectional view taken along section line 5—5 on FIG. 4.

The washer 14 is in the form of a circular disc 46 having a central hole 48 therein which is received on the depending flange 36. The upper surface 50 of the washer 14 is substantially flat and tapers downwardly at its periphery as indicated by numeral 52. The undersurface 54 of the washer is slightly thicker centrally then at the periphery and generally conforms to the cup depression 13. The undersurface 54 is provided with depending ribs 56 and 58 with the ribs 58 extending substantially to the center hole and the ribs 56 being disposed outwardly from the center hole in radially spaced relation thereto and disposed between adjacent ribs 58. As illustrated in FIG. 5, each of the ribs is provided with a convexly curved surface 60 and a flat surface 62 so that when the washer 14 is compressed between the plate 20 and the cup-shaped depression 13 in the stone 12, the ribs 56 and 58 fold over thus creating an anti-rotation or anti-torque effect thereby preventing rotation of the handle 10 in relation to the stone 12 when the bolt 16 is tightened. The ribs are located in the central portion of the washer and the flattened or tapered peripheral portion 52 provides for the washer to be accurately fitted to the depressed cup 13 inasmuch as the washer periphery can be cut down to the necessary size to fit within the shallow cupped stones. The washer is constructed of plastics such as an ethylvinyl acetate and may be approximately 4⅝ inches in diameter and fits only into the cup and does not extend all the way to the edge of the plate 20 so that the curved portion 22 of the plate 20 will intimately contact the contour of the curling stone 12.

The upper surface of the plate is provided with a plurality of recesses 64 receiving decals 66 which are substantially flush with the surface. These decals may be oriented between the gooseneck handle portion 24 and the adjacent peripheral edge of the curved portion 22 and may include numerical indicia or the like and may also be oriented at the two opposite sides of the handle 10. The handle 10 may be colored any suitable and distinguishable color to provide identification for spectators, television viewers and the like. With the particular construction of the handle 10 and the washer 14, there is virtually no dead space between the handle and the stone surface and therefore, the device is virtually noise-free and does not produce a loud clacking or echo when there is a stone-to-stone contact. The upper surface of the washer and bottom surface of the handle frictionally engage with great resistance to relative rotation due partly to compression and partly to the ethylvinyl acetate material which effectively grips the polycarbonate glass-filled resin from which the plate 20 is constructed.

The bolt head 42 will fit all stones and is of steel, zinc-plated construction thus eliminating brass-to-brass threading inasmuch as the ferrule 32 is brass. When a brass bolt and a brass insert is used, severe binding occurs due to metal fatigue which is reduced or eliminated by using a steel bolt engaged with the brass ferrule. With this construction where the bolt is rotated and the handle and washer remain stationary, the assembly or disassembly operation can be quite rapidly performed and the compression of the washer and intimate contact between the bottom surface of the plate and the stone occurs without rotation of either component thereby providing a connection between the handle, washer and stone which resists rotation and thus resists loosening of the handle.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a curling stone having a center hole and a shallow cup-shaped recess in the upper and lower surfaces thereof, and a handle therefor comprising a generally circular plate having a downwardly curved peripheral edge and a gooseneck handle extending upwardly from an edge portion thereof, said plate closely conforming with and engaging the upper surface of the stone, rotatable fastening means connected with the central portion of the plate and extending into the center hole of the stone, and a washer of resilient material having a central bore interposed between the plate and the cup-shaped recess in the stone for frictionally engaging the stone and plate when compressed by actuating the fastening means while maintaining the handle non-rotative in relation to the stone, said washer being disposed solely in the cup-shaped recess in the stone and including compressible rib means thereon for resisting relative rotation between the stone and plate, said rib means including a plurality of ribs extending radially from said bore on only one side of the washer, said ribs having one flat side surface and a convexly curved opposite side surface for folding when the washer is compressed whereby the folded and compressed ribs will prevent rotation between the washer and curling stone.

2. The structure as defined in claim 1 wherein said fastening means includes an internally threaded insert rigid with the plate, a bolt extending through the center hole in the curling stone and including an enlarged head end and a threaded shank portion engaging the insert, and means on the headed end of the bolt for receiving a wrench to enable the bolt to be rotated to pull the plate into conforming engagement with the curved stone and compress the washer between the plate and stone.

3. The structure as defined in claim 2 wherein said means on the headed end of the bolt includes a polygonal recess in the flat outer end of the headed end of the bolt, said headed end of the bolt being in the form of a conical member.

4. The structure as defined in claim 1 wherein said washer includes a tapered peripheral edge conforming to the diameter of the cup-shaped recess, said washer being thicker centrally and provided with a flat upper surface and a slightly tapering undersurface from the center toward the periphery and tapering more sharply at the periphery.

5. The structure as defined in claim 1 wherein said plurality of radially extending ribs includes a first group of said ribs extending substantially to said center bore and a second group of said ribs being disposed radially outwardly a greater distance from said bore than said first group and disposed between adjacent ribs of the first group.

* * * * *